United States Patent [19]

Bustin

[11] 4,027,451

[45] June 7, 1977

[54] FREE FLOW GRATING

[76] Inventor: Leopold Bustin, Emmans Road, Flanders, N.J. 07836

[22] Filed: Mar. 30, 1976

[21] Appl. No.: 671,833

[52] U.S. Cl. ..... 52/664; 52/177

[51] Int. Cl.[2] ..... E04C 2/42

[58] Field of Search ..... 52/177, 180, 633, 660–676

[56] References Cited

UNITED STATES PATENTS

| | | | |
|---|---|---|---|
| 1,134,032 | 3/1915 | Clarke | 52/180 X |
| 1,180,953 | 4/1916 | Steckenreiter | 52/180 |
| 2,384,303 | 9/1945 | Heath | 52/668 |
| 2,645,985 | 7/1953 | Beebe et al. | 52/668 X |
| 2,668,484 | 2/1954 | Bustin | 52/668 X |

OTHER PUBLICATIONS

"Bustin Steel Products," Catalog, Nov. 1967, p. 51.

*Primary Examiner*—J. Karl Bell
*Attorney, Agent, or Firm*—Carella, Bain, Gilfillan & Rhodes

[57] ABSTRACT

A grating having a plurality of grating strips in rigid spaced relationship. The upper and lower edges of each strip are relieved to define spaced recesses. Recesses in the lower edges are deeper than those in the upper edges and adjacent strips are longitudinally staggered to cause misalignment of the lower recesses.

3 Claims, 3 Drawing Figures

FREE FLOW GRATING

BACKGROUND OF THE INVENTION

This invention relates to support devices. More particularly, this invention relates to gratings for supporting loads.

Gratings, both wooden and metal type, have been used for many years for support means. Traditionally, gratings have been used as floor type supports in areas where visual access or fluid pass-through capabilities are required. Also, gratings have been used as stair treads and the like where non-skid benefits, visual access or fluid flow-through capabilities are desired.

One area of potential use for metal gratings which has not been fully exploited, however, is that which requires the free flow of fluid, e.g. air, water or the like, under the grating rather than through the grating. Thus, in cold storage areas where it is desirable to keep stored product dry notwithstanding the occurrence of continuing condensation, metal gratings have proved inadequate because their span required for permitting free fluid flow has been too great to permit adequate support. Alternatively, if adequately supported, their free flow area has been restricted considerably.

This same difficulty arises with respect to floor racks for maintaining loads off the floor for sanitary reasons as well as for support means wherein it is desirable to circulate warm area or desiccated air not only around stored products but also under stored products.

An additional difficulty with recognized flow type gratings has been that such gratings in the past have been relatively expensive to manufacture and thus commercially less desirable than they otherwise might be.

SUMMARY OF THE INVENTION

It is an object of the present invention, therefore, to provide a support grating of the free flow type wherein the lower grating surface is sufficiently open to permit a free flow of fluids therethrough.

Another object of the present invention is the provision of a support grating which is capable of supporting heavy loads without significant sag and without impending the free flow of fluids therethrough.

A still further object of the present invention is to provide a free flow type deck grating which is economical to manufacture and susceptible of mass production techniques.

These objects and others not enumerated are achieved by free flow grating structured according to the present invention, one embodiment of which may include a plurality of longitudinally extending grating strips, each of the strips including an upper longitudinally extending edge, a lower longitudinally extending edge, spaced from and generally parallel to the upper longitudinally extending edge, a first end edge generally normal to and extending between said upper and lower longitudinally extending edges, a second end edge spaced from and generally parallel to the first end edge and extending between the upper and lower longitudinally extending edges, first and second generally parallel side surfaces the perimeter of which being defined by the end edges and the upper and lower longitudinally extending surfaces, a plurality of relieved areas formed in each of said strips and longitudinally spaced along the upper and lower surfaces, the depth of the relieved areas in the lower surface being greater than the depth of the relieved areas in the upper surface, and securing means for rigidly securing the grating strips together in generally parallel relationship.

BRIEF DESCRIPTION OF THE DRAWINGS

A more complete understanding of the present invention may be had from the following detailed description particularly when read in the light of the accompanying drawings wherein.

DETAILED DESCRIPTION

Figure 1:
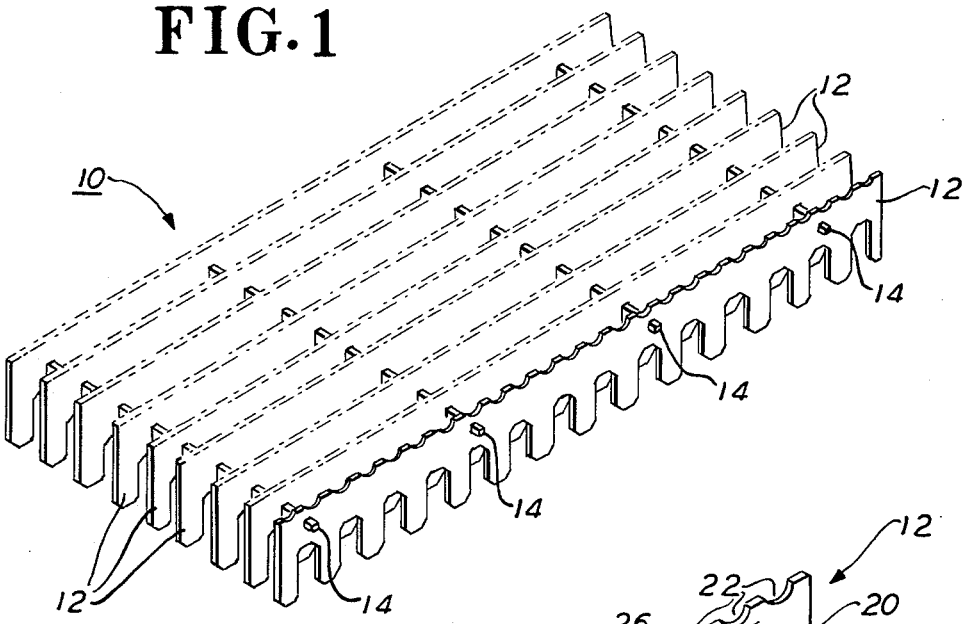
FIG. 1 is a perspective view of one embodiment of free flow grating according to the invention

Referring to FIG. 1, there is designated generally by the reference numeral 10 a free flow grating structured in accordance with the invention. Grating 10 includes a plurality of longitudinally extending grating strips 12. Each of the grating strips 12 is substantially identical in structure and the grating strips 12 are maintained in spaced longitudinally extending parallel relationship by a plurality of staking rods 14.

Figure 2:
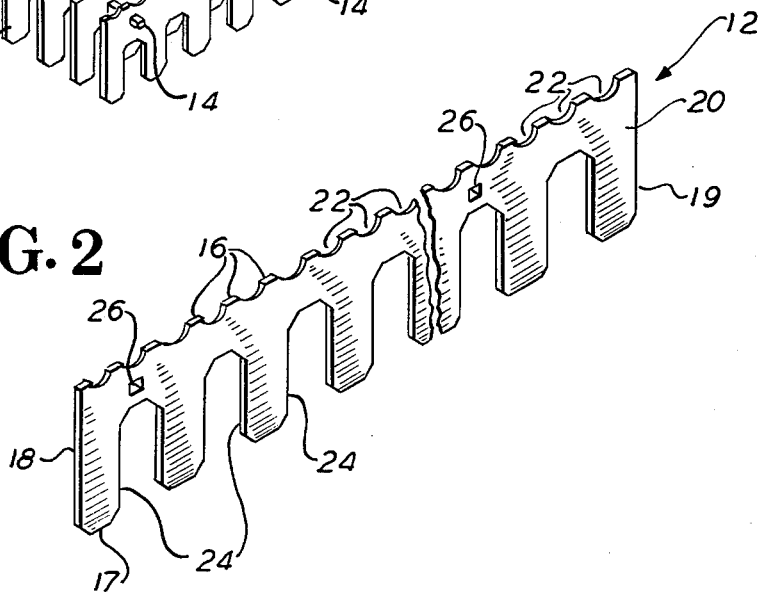
FIG. 2 is a perspective view of a single grating strip used in conjuction with the embodiment of FIG. 1.

Referring to FIG. 2, there is shown a grating strip 12 in expanded perspective view.

Grating strip 12 can be seen to comprise an upper longitudinally extending edge 16, a lower longitudinally extending edge 17, a first end edge 18 and a second end edge 19. End edges 18 and 19 are generally parallel to and spaced from each other and each extends from the lower longitudinally extending edge 17 to the upper longitudinally extending edge 16.

The major surfaces of grating 12 are a first side surface 20 and a second side surface not shown. It is evident from the Figure that the perimeter of the side surfaces is defined by the first and second end edges as well as the upper longitudinally extending edge and the lower longitudinally extending edge 16 and 17 respectively.

Formed in upper longitudinally extending edge 16 are a plurality of substantially identical relieved recesses 22. Recesses 22 are formed in a manner to be discussed below and are longitudinally spaced one from the other.

Similarly, there are formed in lower longitudinally extending edge 17 a plurality of relieved areas defining recesses 24. Recesses 24 are longitudinally spaced and are formed in a manner similar to the formation of recesses 22 all as discussed below.

Also formed through strip 12 are as discussed below. centrally disposed openings 26. Openings 26 may be formed by punching and are provided to accommodate therethrough the passage of securing rods 14.

As may not be evident from the drawing, the recess spaces 24 are identical in shape to the adjacent portion of grating strip 12. Thus, two sections of grating strip 12 may be manufactured from a single piece of stock material in the manner defined in my U.S. Pat. No. 3,803,894 for Method of and Appartus for Manufacturing a Plurality of Continuous Serrated Metal Strips from a Single Strip of Feed Stock.

Thus, in the manufacture of grating strips a plurality of grating strips may be manufactured in the manner disclosed in detail in my above-identified patent and the strips so formed may thereafter be passed through a punching machine to form recesses 22 as well as openings 26.

After having formed the individual grating strips, a plurality of grating strips may be positioned in basicially parallel relationship whereupon staking rods 14 are passed through openings 26 and then the staking rods are swaged to cause the grating strips to be retained rigidly in parallel relationship. Thus, it can be seen that the free flow grating according to the invention is well susceptible of being manufactured by commercially acceptable techniques and the cost thereof is thus reasonably low.

It should also be noted that gratings according to the invention may be manufactured from material generally known in the art including aluminum and stainless steel.

Figure 3:
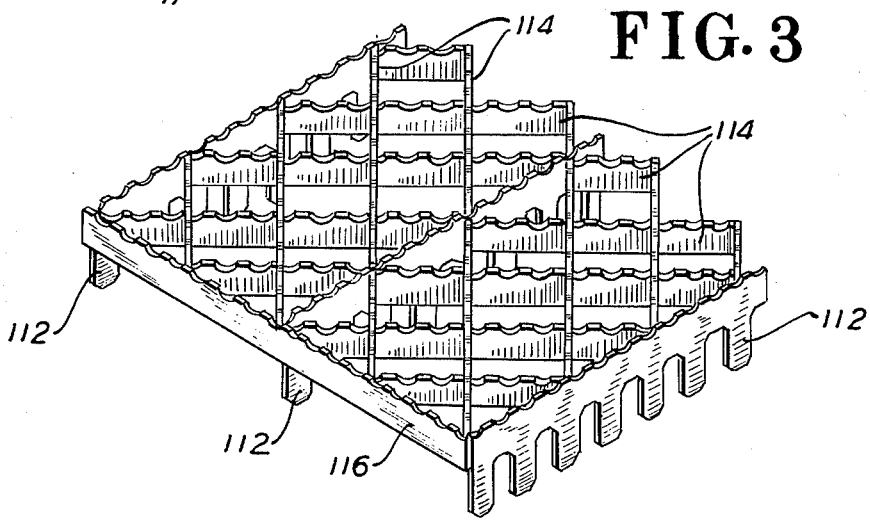
FIG. 3 is a perspective view of a second embodiment of free flow grating structured in accordance with the invention.

Referring to FIG. 3, there is shown a second embodiment of free flow grating structure in accordance with the present invention.

The free flow grating of Fig. 3 includes a plurality of longitudinally extending grating strips 112 which are secured in spaced parallel relationship by the interposition of standard grating elements 114. Thus, the standard grating elements which are approximately one half the overall depth of each grating strip are positioned between adjacent grating strips and the grating elements are secured to the grating strips by conventional means such as welding. Additionally, there by be provided an end strip 116 which eliminates sharp edges and surfaces at the end of the grating element and also is rigidly secured, e.g. by welding, to the grating strips and grating element such as to assist in maintaining the overall structure in rigid relationship.

Referring to both FIGS. 1 and 3, it can be seen that the grating structured according to the invention provides large openings or recesses along the lower edge of the grating strip. These recesses are of sufficient cross-sectional area to permit the free flow of fluid under the major porton of the grating thus permitting water to run off without causing damage to products stored on the grating and also to permit the free flow of air where such is desired.

With particular reference to FIG. 1, it should be noted that adjacent grating strips although parallel are somewhat longitudinally displaced such that the openings 24 in each strip are transversely misaligned. This misalignment is done intentionally so as to present a tortuous path under the grating. Such tortuous path for fluid passing under the grating is desirable where heat exchange is being accomplished, i.e. to achieve a better circulation and more devious circulation of the heat exchange medium under the grating and also in shipboard uses where water on the surface of a deck may have a free surface effect. Thus, the provision of the tortuous path under the grating adds to the stability of a vessel and also provides for improved heat exchange characteristics of the grating in situations such as those wherein the grating is used in desiccation or also is used in warming or the like.

It will be evident to those skilled in these arts that the grating in accordance with the present proposal is novel and a step forward in overall grating designs. Prior grating structures which were desired to be utilized for the uses enumerated above have fallen far short of their intended goals. The grating as proposed above is economical to manufacture, economical to assemble, and capable of being manufactured from durable materials which will assure long life. This when considered in the light of the efficiency of operation of such grating makes this product welcome in the marketplace.

Although the invention has been disclosed in terms of two representative embodiments, it will be recognized by those having skill in these arts that many modifications and variations may be made to the invention as claimed without departing from the spirit and the scope thereof.

What is claimed is:

1. A free flow grating comprising:

a plurality of longitudinally extending grating strips, each of said grating strips including an upper longitudinally extending edge and a lower longitudinally extending edge spaced from and generally parallel to said upper longitudinally extending edge, a first end edge generally normal to and extending between said upper and lower longitudinally extending edges, a second end edge, spaced from and generally parallel to said first end edge and extending between said uper and lower longitudinally extending edges, first and second generally parallel side surfaces, the perimeter of said side surfaces generally being defined by said upper and lower longitudinally extending edges and said first and second end edges;

a plurality of relieved areas formed in each said strip and longitudinally spaced along said upper longitudinally extending edge;

a plurality of relieved areas formed in each said strip and longitudinally spaced along said lower longitudinally extending edge, said relieved areas in said lower edge of each said strip being uniformly longitudinally spaced and substantially identical in shape to each adjacent relieved area, said relieved areas along each said lower longitudinally extending edge extending deeper into said strip than the depth of the relieved areas in said upper longitudinally extending edge of each said strip;

said plurality of grating strips positioned longitudinally such that the relieved areas in the lower longitudinally extending edge of adjacent grating strips are not in alignment; and securing means for rigidly securing said plurality of grating strips together and in general parallel relationship.

2. A free flow grating comprising:

a plurality of longitudinally extending grating strips, each of said grating strips including an upper longitudinally extending edge and a lower longitudinally extending edge spaced from and generally parallel to said upper longitudinally extending edge, a frist end edge generally normal to and extending between said upper and lower longitudinally extending edges, a second end edge spaced from and generally parallel to such first end edge and extending between said upper and lower longitudinally extending edges, first and second generally parallel side surfaces, the perimeter of said side surfaces generally being defined by said upper and lower longitudinally extending edges and said first and second end edges;

a plurality of relieved areas formed in each said strip and longitudinally spaced along said upper longitudinally extending edges, said relieved areas in each said upper edge being uniformly longitudinally spaced and each said relieved area in each said upper surface being substantially identical in shape to each said adjacent relieved area;

a plurality of relieved areas formed in each said strip and longitudinally spaced along said lower longitudinally extending edge, said relieved areas along said lower longitudinally extending edge extending deeper into said strip than the depth of the relieved areas in said upper longitudinally extending edge, said relieved areas in said lower longitudinally extending edges being uniformly longitudinally spaced and substantially identical in shape to each adjacent relieved area and each longitudinally extending edge;

said plurality of grating strips being positioned longitudinally such that the relieved areas in the lower longitudinally extending edges of adjacent grating strips are not in alignment; and securing means for rigidly securing said plurality of grating strips together and in generally parallel relationship.

3. A free flow grating according to claim 1 and including first and second end strips, said first end strip being secured to the first end edges of each of said grating strips and the second end strip being secured to the second end edges of each of said grating strips.

* * * * *

UNITED STATES PATENT OFFICE

CERTIFICATE OF CORRECTION

Patent No. 4,027,451 Dated June 7, 1977

Inventor(s) LEOPOLD BUSTIN

It is certified that error appears in the above-identified patent and that said Letters Patent are hereby corrected as shown below:

Column 1, line 45 "pending" should be --peeding--

Column 2, line 53 "Also formed through strip 12 are as discussed below." should be --Also formed through strip 12 are a plurality of generally--

Column 2, line 58 "portion" should be --portions--

Column 4, line 21 "uper" should be --upper--

Column 4, line 53 "frist" should be --first--

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*